US005482442A

United States Patent [19]

Blair et al.

[11] Patent Number: 5,482,442

[45] Date of Patent: Jan. 9, 1996

[54] HYDRAULIC RADIAL PISTON MACHINES

[75] Inventors: Arthur A. Blair; Christian H. Thoma, both of Jersey, Great Britain

[73] Assignee: Unipat AG, Glarus, Switzerland

[21] Appl. No.: 190,374

[22] Filed: Feb. 2, 1994

[30] Foreign Application Priority Data

| | | | |
|---|---|---|---|
| Feb. 2, 1993 | [GB] | United Kingdom | 9301963 |
| Jun. 18, 1993 | [GB] | United Kingdom | 9312574 |
| Dec. 15, 1993 | [GB] | United Kingdom | 9325631 |

[51] Int. Cl.[6] ..... F04B 27/04

[52] U.S. Cl. ..... 417/220; 417/273; 91/497

[58] Field of Search ..... 417/220, 273, 417/219; 91/497, 491

[56] References Cited

U.S. PATENT DOCUMENTS

| | | | |
|---|---|---|---|
| 1,721,225 | 7/1929 | Levering | 91/482 |
| 2,453,538 | 11/1949 | Rauch | 417/219 |
| 2,741,993 | 4/1956 | Orshawsky | 91/497 |
| 2,827,859 | 3/1958 | Crane | 91/497 |
| 3,756,749 | 7/1973 | Aldinger | 417/220 |
| 3,955,477 | 5/1976 | Rutz | 91/497 |
| 4,056,042 | 11/1977 | Rutz et al. | 91/497 |
| 4,686,829 | 8/1987 | Thoma et al. | 60/464 |
| 4,920,859 | 5/1990 | Smart et al. | 91/497 |
| 5,228,290 | 7/1993 | Speggiorin | 91/497 |

FOREIGN PATENT DOCUMENTS

| | | | |
|---|---|---|---|
| 219455 | 7/1981 | German Dem. Rep. | 91/497 |
| 4402470 | 8/1994 | Germany | 417/273 |
| WO93/24734 | 12/1993 | WIPO . | |

*Primary Examiner*—Richard A. Bertsch
*Assistant Examiner*—Peter G. Korytnyk
*Attorney, Agent, or Firm*—Young & Thompson

[57] ABSTRACT

A radial piston hydrostatic machine contained within a housing and comprising a cylinder-barrel mounted to rotate on a pintle-valve fixed to said housing. Two hydraulic-rams operatively acting on a track-ring to provide eccentric displacement relative to the pintle-valve to change the rate of fluid output from the machine. The hydraulic-rams being of unequal size and subjected to the same level of machine discharge pressure during periods when the level of discharge pressure is insufficient to cause an internally disposed pressure relief-valve to "open". A throttle-valve disposed in a fluid channel linking the cylinders of said hydraulic-rams and arranged to introduce a pressure differential across two said two cylinders during periods when the machine discharge pressure is sufficiently high to cause said pressure-relief-valve to "open".

17 Claims, 4 Drawing Sheets

HYDRAULIC RADIAL PISTON MACHINES

FIELD OF THE INVENTION

This invention relates to positive displacement rotary radial piston hydraulic machines, and is particularly directed at further improvements to the displacement control system for such a machine incorporating a 2-piece housing structure as described in our pending International Application No. PCT/GB-93/01051.

In the radial piston type of hydraulic machine, a cylinder-barrel is mounted for rotation on a ported pintle-valve, and is provided with a number of generally radial cylinder-bores. Each cylinder-bore contains a piston and each piston engages through a slipper onto a surrounding annular track-ring. The arcuate-ports in the pintle-valve are arranged to communicate with fluid inlet and outlet conduits attached to the exterior of the machine, and thus rotary movement of the cylinder-barrel is accompanied by radial displacement of the pistons and corresponding displacement of fluid through these fluid conduits. The control-system acts in determining the degree of eccentricity required between the track-ring and pintle-valve, and therefore regulates the supply of hydraulic fluid output from the hydrostatic machine to meet the varying fluid demand of the hydraulic circuit.

Most variable-displacement machines use some form of pressure governing control apparatus for operating the track-ring to change the rate of fluid delivered when the pressure in the system reaches a certain level. Increasingly, the industry has used spool-valves that operate similar to on/off switches by metering fluid to and from the main hydraulic-ram that actuates the track-ring. An example is shown in the invention of William Rauch, U.S. Pat. No. 2,453,538.

Although in the main, such spool-valves perform satisfactorily, there are occasions when such a control system can become unstable during operation. It is therefore an object of the present invention to provide an improved control-system that is less prone to instability, and yet is simple and economic to include in such hydraulic machines.

SUMMARY OF THE INVENTION

From one aspect, the invention consists in a radial piston hydrostatic machine having a rotary drive-shaft, a housing supporting the shaft and comprising two shells connectable together along a parting plane, a pivotable track-ring the relative position of which determines the operation and performance of the machine and means for controlling the position of the track-ring, wherein the control means includes a actuation support means containing internal fluid channels and wherein the actuation support means is located, retained and/or formed in the housing by the shells.

Hydraulically-operated actuating hydraulic-rams are contained within the actuation support means, and act on a pivotable track-ring member for determining the output delivery rate for the machine.

A further feature of the invention utilises a fluid throttle-valve in combination with a pressure-relief-valve to create the required pressure differential between the two hydraulic-rams for efficient and effective dynamic operation of the machine, and where preferably, both the throttle-valve and pressure relief-valve are also contained within the actuation support means.

During operation of the machine, the smaller of the two hydraulic-rams is continuously subjected to the full delivery pressure of the machine, whereas the larger hydraulic-ram is only subjected to the same level of pressure during periods when the relief-valve remains "closed" and the throttle-valve remains inactive. Therefore during periods when the same level of pressure is acting behind both hydraulic-rams, the resulting force provided by the larger hydraulic-ram on one side of the control-pin is greater than the resulting force provided on the opposite side of the control-pin by the smaller hydraulic-ram. As a result, the greater force provided by the larger hydraulic-ram is predominant in determining the eccentric position of the track-ring relative to the pintle-valve.

However when the delivery pressure from the machine is sufficiently high to cause the relief-valve to "open", the pressure level acting behind the large hydraulic-ram falls, and as a consequence, the smaller hydraulic-ram (which is still subjected to the full delivery pressure) now becomes predominant in effectively determining the eccentric position of the track-ring relative to the pintle-valve. During this phase of machine operation, the respective fluid pressure levels acting behind the two hydraulic-rams is a function of the difference in magnitude of the relief-valve "cracking" pressure and the full machine delivery pressure, as well as the pressure differential caused by a pressure-drop across the throttle-valve.

A still further feature of the invention concerns improved means for eliminating initial end play or clearance between the track-ring and the actuation support means, and thereby significantly reducing the vibration between the associated components. The track-ring of is mounted on a pivot-pin and allowed limited articulation about the axis of the pin, and where the clearance eliminating means may comprise two spring-clips that act to bias the track-ring against the actuation support means. The biasing spring-clips become active only once the housing shells are locked together during final assembly of the machine, and preferably, they are provided with sufficient resilience to be automatically self-adjusting to compensate for wear in the associated componentry during the service life of the machine.

BRIEF DESCRIPTION OF THE DRAWINGS

The invention may be performed in various ways and one specific embodiment is now described by way of example with reference to the accompanying drawings, in which:

As shown in FIGS. 1–4, the machine 1 comprises an outer housing structure which surrounds the internal working piston elements. The housing structure may be formed by two shells 3, 4 of part-cylindrical form which interface with each other on a common parting plane 5 along which the axes of the drive-shaft 6 and pintle-valve 7 lie. Each shell 3, 4 is provided with an opening 69, 70 respectively, the openings communicating the interior and exterior surfaces of each shell together.

Shell 3 is provided with one large semi-circular pocket 8 and a number of smaller semi-circular recesses such as those shown as 9, 11. Similarly shell 4 is also provided with an equal number of such pockets and recesses, shown for example, as pocket 16 and recesses 12, 17.

Figure 3:
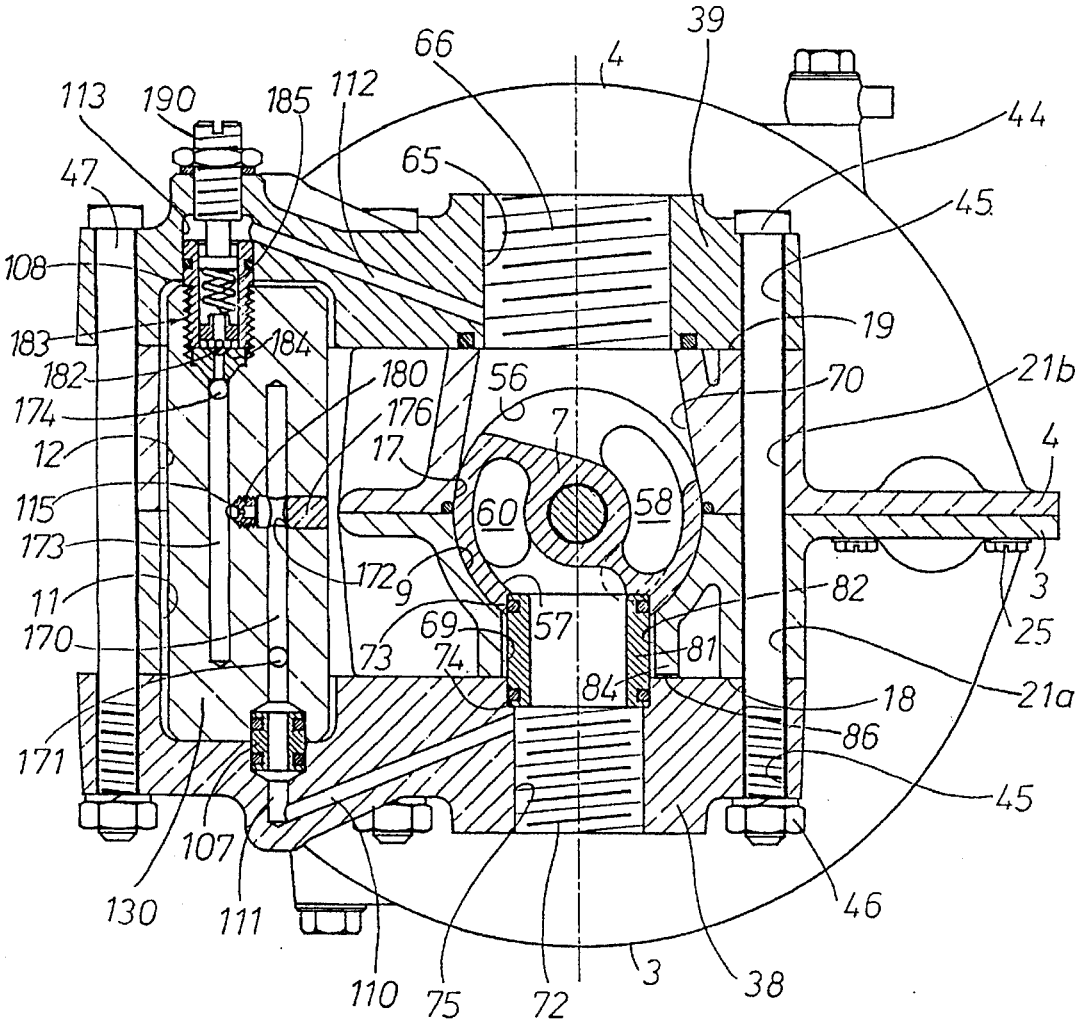
FIG. 3 is a cross sectional view along line II—II of FIG. 1.
Figure 4:
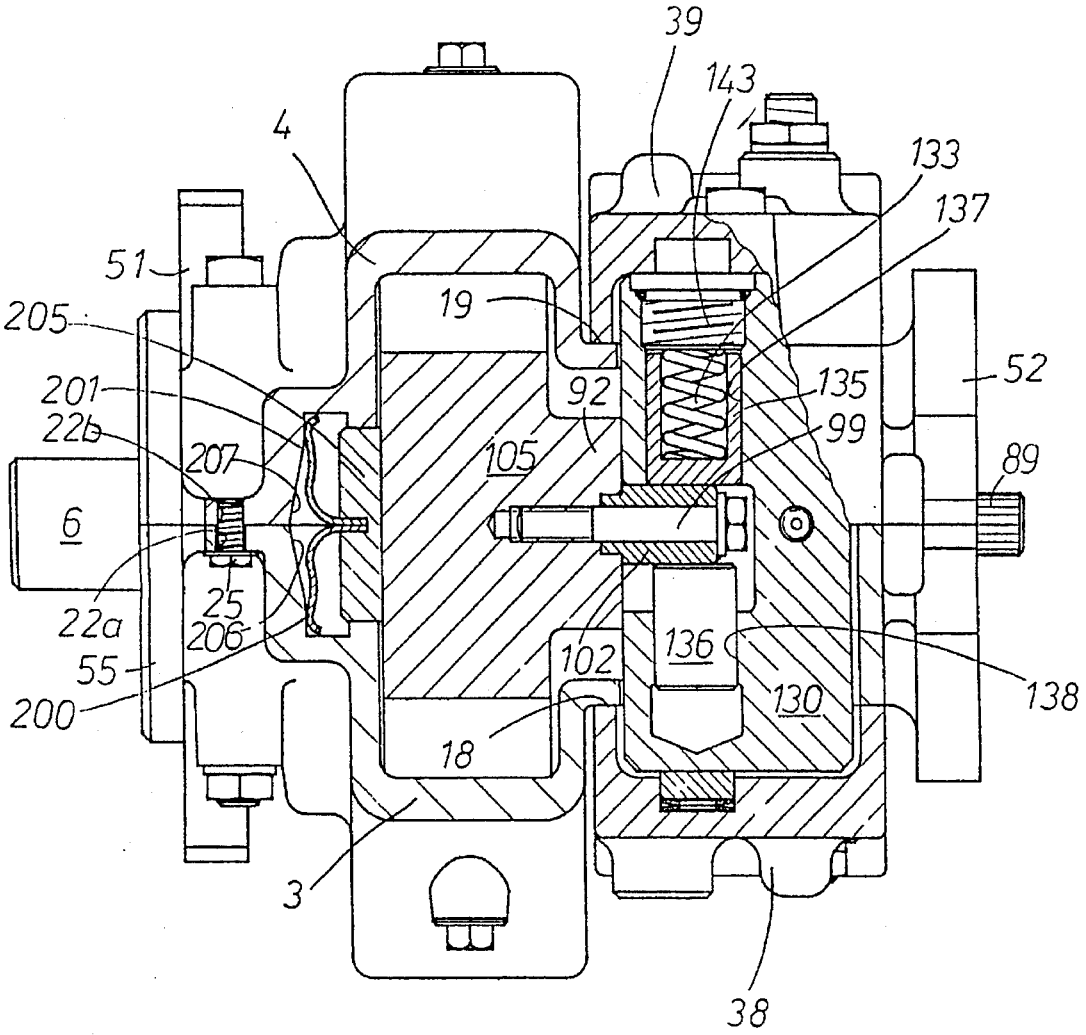
FIG. 4 is a longitudinal view along line III—III of FIG. 2.

Attachment points are provided in both shells, for instance, holes 20*a*, 21*a*, 22*a* in shell 3 to correspond with a similar number of holes in shell 4, shown for example as hole 22*a* in FIG. 3 and hole 22*b* in FIG. 4.

The exterior of each shells 3, 4 is provided with a flat mounting face 18, 19 onto which respective flange-element 38, 39 are attached.

Figure 1:
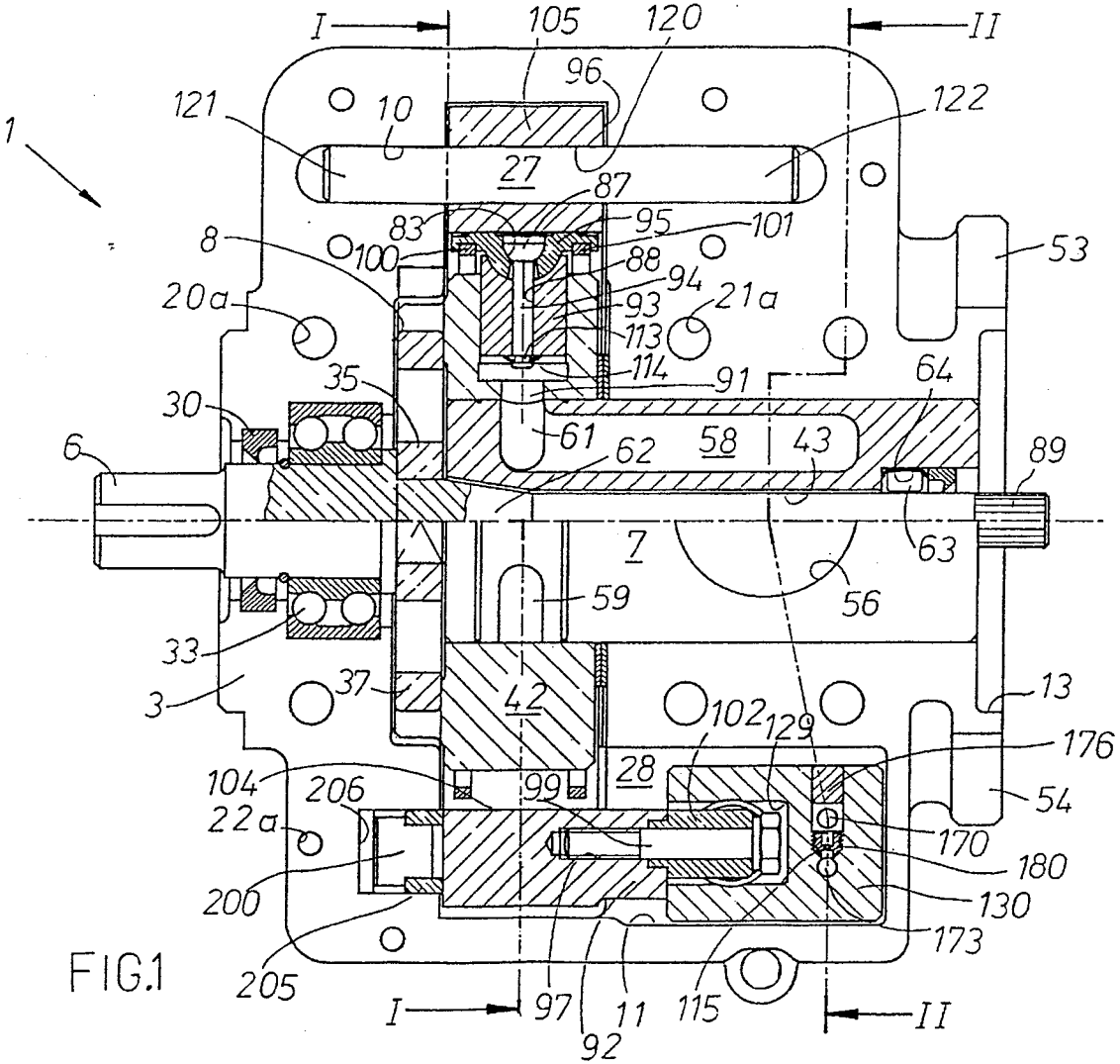
FIG. 1 is a longitudinal view of a hydrostatic machine according to the invention.

Once all the internal elements of the machine 1 have been positioned in place in the interior of shell 3, anaerobic-sealant is applied, by a process such as "silk-screening", to the upper exposed surface of shell 3 as shown in FIG. 1 along which lies the parting plane 5. Shell 4 is then lowered onto shell 3 along parting plane 5, and a number of self-threading screws 25 are attached as shown for example, in holes 22*a*, 22*b* of FIG. 4. Flange-elements 38, 39 are then attached to their respective mounting faces 18, 19 on shells 3, 4 and bolts 44 inserted through holes 21*b*, 22*a*, 45 to engage with nuts 46. A further bolt 47 is also used as shown in FIG. 3. Once all the self-threading screws 25 and bolts 44, 47 have been tightened, shells 3, 4 are thus locked together to form the complete housing structure for the machine 1.

Thus when shells 3, 4 are together, respective recesses in each shell combine to form complete apertures, for instance, recesses 8, 16 combining as an aperture which forms the internal-chamber 26 of the machine. Likewise, recesses 9, 17 combine to form an aperture which surrounds the pintle-valve 7. After the anaerobic sealant has cured, the resulting internal-chamber 26 is sealed from the outer surrounding environment.

Further recesses are formed in each respective shell 3, 4 and are used to support other internal elements of the machine, for instance, recess 10 in shell 3 combines with a corresponding recess (not visible) in shell 4 creating an aperture that provides the support surface for the pivot-pin 27. Similarly, recesses 11, 12 combined together to provide an internal sub-chamber 28 for the various internal elements that comprise the displacement control-system mechanism for the machine 1.

In order to provide a mounting surface for the purpose of attaching the hydraulic machine to a remote and separate structure, each shell 3, 4 is provided with outwardly extending arms (only arm 50 visible in FIG. 2) which when the shells 3, 4 are together provide the first mounting-flange member 51.

To allow a further hydrostatic machine to be attached to the first hydrostatic machine 1, a second mounting-flange member 52 is included at the rear end of machine 1. In this case, each shell combines with the other shell to form the outwardly extending arms 53, 54 as shown in FIG. 1. In effect, the outwardly extending arms 53, 54 of the second mounting-flange member 52 are arranged to be perpendicular to those outwardly extending arms 50 of the first mounting-flange member 51.

Register 55 is provided on the first mounting-flange member 51 and similarly, register 13 is provided on the second mounting flange-member 52.

Description of the internal elements

A shaft-seal 30 is positioned between shells 3, 4 to surround the drive-shaft 6 in order to prevent any fluid from escaping from the internal-chamber 26.

Respective shells 3, 4 combine to form the cylindrical location pocket for a bearing such as ball-bearing 33 which supports drive-shaft 6.

For applications where two or more hydrostatic machines need to be driven from the same drive-shaft, the present invention teaches the use of a single drive-shaft 6 which is waisted in diameter in the region shown as 62 allowing it to extended through the interior (hollow passage 43) of the pintle-valve 7 to protrude at 89 from the rear side of the machine 1. A self-aligning bearing 63 is located within a pocket 64 provided in the pintle-valve 7 so to provide further support for drive-shaft 6.

Figure 2:
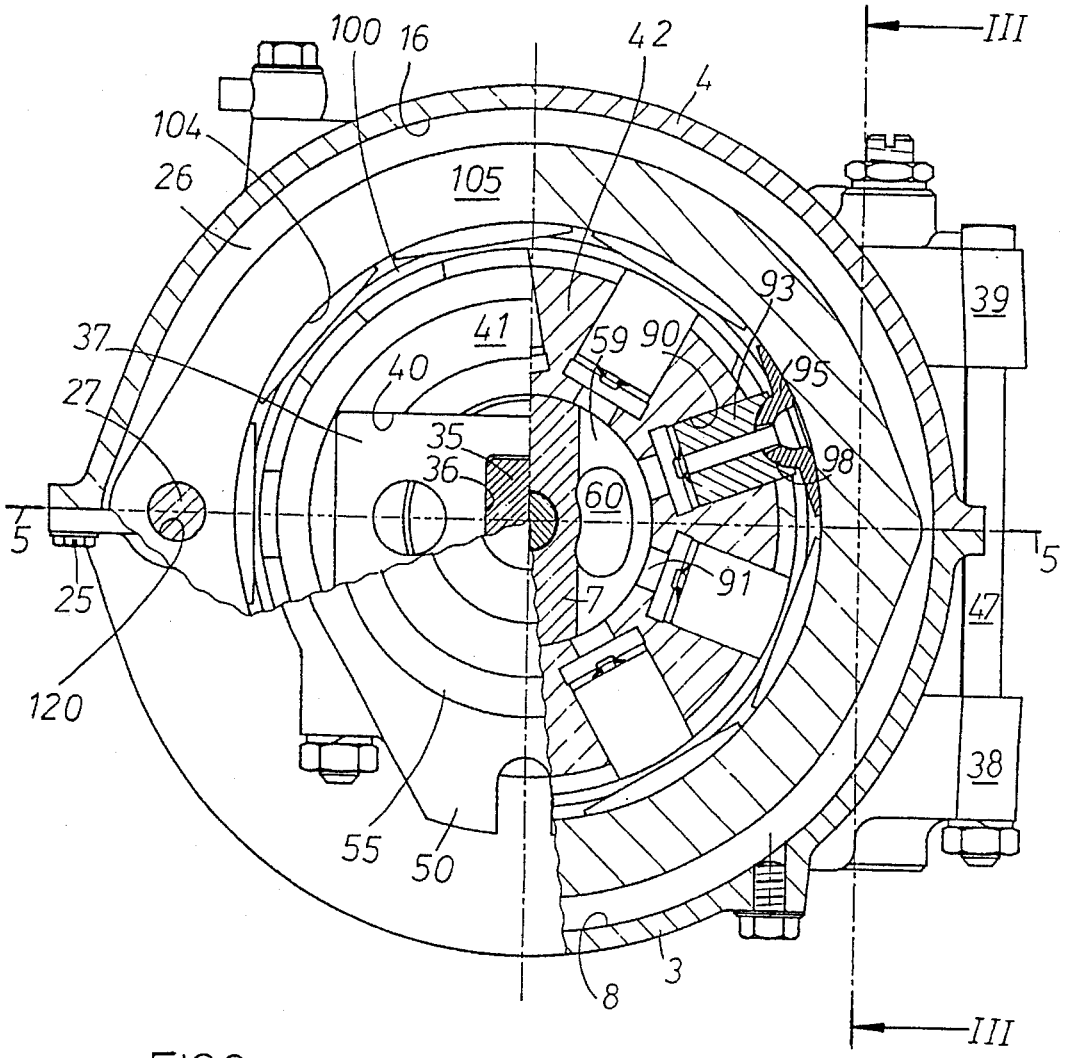
FIG. 2 is a cross sectional view along line I—I of FIG. 1.

As shown in FIG. 2, a tongue 35 is provided on drive-shaft 6 which fits a corresponding slot 36 provided in an "oldham" type misalignment coupling 37. The coupling 37 fits into a slot 40 provided on the end face 41 of the cylinder-barrel 42, and acts to compensate for any inaccuracy that may exists between the respective axes of the drive-shaft 6 and pintle-valve 7.

As shown in FIG. 3, two pintle-ports 56, 57 are provided in pintle-valve 7, and where pintle-port 56 is connected by an internal longitudinal bore 58 to arcuate-port 61. Pintle-port 57 is connected by an internal longitudinal bore 60 to arcuate-port 59.

Flange-element 39 has a low-pressure fluid admittance passageway 65 which interfaces with opening 70 provided in shell 4. Opening 70 is positioned to interface with pintle-port 56 in the pintle-valve 7. The longitudinal axes of both passageway 65 and opening 70 are substantially coincident, and thereby arranged to be perpendicular to the parting plane 5 of the machine 1. Passageway 65 is threaded 66 in order to accept suitable external fluid-conduits for connection of the machine to a hydraulic circuit. Similarly, flange-element 38 has a high-pressure fluid discharge passageway 75 which is threaded 72 in order to accept a suitable external-conduit.

Opening 69 provided in shell 3 is positioned to interface with both passageway 75 and pintle-port 57. Location recesses 73, 74 are provided in both the pintle-valve 7 and flange-element 38 as shown in FIG. 3 to locate a liner-element 81. The liner-element 81 acts to fluidly couple pintle-port 57 with passageway 75, and thereby effectively lines opening 69 to prevent the surrounding wall 84 of shell 3 from being subjected to high pressure fluid.

If in the event of a small amount of leakage of pressurized fluid from the liner-element 81, a drainage groove 86 is provided which connects the annular cavity 82 surrounding the liner-element 81 with the internal chamber 26 of the machine 1. Thus any leakage of pressurized fluid is caused to become de-pressurised immediately on entering annular cavity 82. As a result, there is no likelihood of the housing structure failing, as pressurized fluid is prevented from gaining access to the parting plane 5 between the shells 3, 4, which could otherwise cause the shells 3, 4 to become prized apart and separated.

The cylinder-barrel 42 is supported for rotation on the pintle-valve 7 and includes a number of cylinder-bores 90 each connected through a respective "necked" cylinder-port 91 to allow fluid distribution between each of the cylinder-bores 90 and a respective pair of elongate arcuate-ports 59, 61 machined into the periphery of the pintle-valve 7.

Each cylinder-bore 90 contains a piston 93 which is attached to a respective slipper 95 by means of a rivet 94. Rivet 94 is a relatively close fit in an axial hole provided in the piston 93 so to allow the required amount of pressurized fluid from cylinder-bore 90 to reach the bearing-face of the slipper 95 for the creation of a hydrostatic bearing in a manner well know in the art. Pistons 93 and slippers 95 mate together on a part-spherical socket 98 to allow articulation of the slipper 95 on the piston 93.

The rivet 94 has a head 87 at one end which is allowed to articulate in a female pocket 83 provided in the interior of the slipper 95. The rivet 94 is provided with a groove 113 at a location just projection from the base of the piston 93 as shown in FIG. 1. A bowed split-washer 114 engages into groove 113 to hold the piston 93 and slipper 95 together.

Guidance-rings 100, 101 are provided and serve to keep the slippers 95 in close proximity with the annular surface 104 of the track-ring 105. This feature combined with the centrifugal force on the piston/slipper serves to enhance the suction characteristics of this type of hydrostatic machine.

The track-ring 105 is provided with a hole 120 into which pivot-pin 27 is located, pivot-pin 27 being extended at either end 121, 122 to protrude from hole 120 to be supported directly in shells 3, 4. Thereby the track-ring 105 is supported within the machine and allowed limited articulated movement about the pivot-pin 27.

A boss 92 is provided on one end face 96 of the track-ring 105 into which a threaded hole 97 is provided. A control-pin comprising a bolt 99 and collar 102 is included, and where the bolt 99 locates into the threaded hole 97 to hold the collar 102 against the end face of boss 92. The collar 102 projects into a cavity 129 provided in the interior of a actuation support means, and where the collar 102 is engaged on opposite sides by actuating hydraulic-rams 135, 136 as shown in FIG. 4.

The actuating support means 130 comprises the main component of the displacement control system for the machine 1, shown positioned between shells 3, 4 and attached to respective flange-elements 38, 39 by means of a hollow-sleeve 107 and the body portion 108 of the pressure relief-valve 183.

Hydraulic-ram 135 is purposely designed to be larger in diameter than hydraulic-ram 136, each being fitted into a respective cylinder 137, 138 in the actuation support means 130. Coil-spring 133 is located behind hydraulic-ram 135 in cylinder 137 so that during periods when the machine 1 operates at low-pressure, the spring 133 biases track-ring 105 to its maximum eccentric position. Plug 143 is used to close off cylinder 137 in actuation support means 130.

In flange-element 38, channels 110, 111 are provided which communicate fluid from the discharge passageway 75 by way of hollow-sleeve 107 to actuating support means 130. Also a channel 112 and chamber 113 are provided in flange-element 39 allowing fluid to be communicated from the actuating support means 130 to the admittance passageway 65 for reasons as will be explained below.

In actuating support means 130, five channels 170, 171, 172, 173, 174 are provided, and where plugs (only plug 176 visible for conduit 172) are used to close the ends of the channels 170, 172, 174.

The fluid from the discharge side of the machine 1 on entering hollow sleeve 107 flows into channels 170, 171, and where channel 171 leads to cylinder 138 containing the small hydraulic-ram 136 so that cylinder 138 always maintains the same pressure level as in the high-pressure discharge passageway 75.

Fluid can also pass from channel 171 into an intersecting channel 172 in which is contained the body portion 180 of a fluid throttling orifice 115. Any fluid passing through orifice 115 enters channel 173, from where it can act against the poppet-head 182 of pressure relief-valve 183. Channel 174 intersects with channel 173 so that fluid can also gain access into the cylinder 137 containing the large hydraulic-ram 135.

During periods when the relief-valve 183 remains "closed", fluid in channels 173, 174 is maintained at the same pressure level as the fluid contained in channels 171, 172 up-stream of the orifice 115. Because hydraulic-ram 135 is larger in area than hydraulic-ram 136, the resulting force produced by hydraulic-ram 135 is greater than the resulting force produced by hydraulic-ram 136, and as a consequence, hydraulic-ram 135 is predominant in determining the degree of eccentricity of the track-ring 105.

During periods when the fluid discharge pressure level from the machine 1 is sufficiently high that the pressurized fluid within channel 173 causes poppet-head 182 to lift off its seat 184 (compressing coil-spring 185), the relief-valve 183 is "opened". Fluid in channels 173, 174 can then flow through chamber 113 and channel 112 to be returned to low-pressure fluid admittance passageway 65 of the machine 1.

As the pressure level in channels 173, 174 falls in value below that still experienced in channels 170, 171, 172 up-stream of the orifice 115, the pressure level acting behind the large area hydraulic-ram 135 is now lower in magnitude than the pressure level acting behind the smaller area hydraulic-ram 136.

Thereby the resulting force produced by the small area hydraulic-ram 136 is now greater than the resulting force produced by large area hydraulic-ram 135, and this causes the small area hydraulic-ram 136 to slide in a a direction towards the open end of its cylinder 138 to move the collar 102, thereby causing the track-ring 105 to partially rotate about the pivot-pin 27 so reducing eccentricity of the track-ring 105 relative to the pintle-valve 7. Therefore during this condition, the small area hydraulic-ram 136 becomes predominant in determining the degree of eccentricity of the track-ring 105.

By such movement, the hydraulic-rams 135, 136 respond to pressure levels in the hydraulic circuit to cause alterations in the degree of eccentricity of track-ring 105 and corresponding alteration in the fluid discharge output from the machine 1.

For the displacement control system of the machine 1 to operate successfully, the level of pressure of the fluid in channels 173, 174 is dependent on both the "cracking" pressure setting of the relief-valve 183 and the amount of induced pressured-drop across the orifice 115, and these act to determine the amount of pressure differential between cylinders 137, 138.

The orifice 115 also prevents a large amount of pressurized fluid passing between channels 170, 173, so that only a small amount of hydraulic energy is lost from high-pressure discharge passageway 75. As a result, even during periods when the relief-valve 183 is "open", the overall volumetric efficiency of the machine is still high.

In order to maintain the track-ring 105 is close relationship with the actuation support means 130, clearance-adjusting means comprising two bent-spring wire-clips 200, 201 are used, which act against a pad 205 to bias track-ring 105 against the adjacent face of the actuation support means 130. The recesses 206, 207 provided in respective shells 3, 4 are purposely angled in order to allow the spring-clips 200, 201 to curl-up on themselves to provide tensioning means as soon as the shells 3, 4 are locked together during assembly. As a result, any clearance that may exist between the track-ring 105 and actuation support means 130 is removed, thereby preventing these components from unduly vibrating during the operation of the machine 1.

Operation of the Machine

The operation of the machine 1 is as follows: Rotation of the drive-shaft 6 causes the cylinder-barrel 42 to rotate. If track-ring 105 is set in an eccentric relationship to the pintle-valve 7, outward sliding movement of the pistons 93 in their respective cylinder-bores 90 is obtained, such that fluid from some external source, such as a hydraulic reservoir, is drawn in via the low-pressure fluid admittance passageway 65 to pintle-port 56, longitudinal bore 58, arcuate-port 61 to the interior of cylinder-bore 90 via "necked" cylinder-port 91. When the piston 93 returns inwards in its cylinder-bore 90, the fluid is expelled from the interior of cylinder-bore 90 via "necked" cylinder-port 91 into the opposite arcuate-port 59 from where it is directed along longitudinal bore 60 to reach pintle-port 57. The fluid then passes through the liner-element 81 to reach the high-pressure fluid discharge passageway 75 for coupling by a conduit to service hydraulic circuit, such as a hydraulic motor. During periods when the poppet-head 182 of relief-valve 183 remains loaded against its seat 184 by coil-spring 185, fluid delivery pressure from the high-pressure fluid discharge passageway 75 of the machine I is received by both hydraulic-rams 135, 136 acting against the collar 102. As the large hydraulic-ram 135 (down-stream of the throttle-valve 180) is larger in area than the small hydraulic-ram 136, the resultant force from the large hydraulic-ram 135 on the collar 102 is sufficient to keep the track-ring 105 in an eccentric relationship to the pintle-valve 7. However, when the force generated by fluid pressure on the poppet-head 182 is greater than the tension of the coil-spring 185, the poppet-head 182 is lifted from its seat 184 to "open" the relief-valve 183 and release fluid to the low-pressure fluid admittance circuit of the machine 1. As a consequence, the pressure level acting behind the large hydraulic-ram 135 falls in value such that it is no-longer sufficient to hold the track-ring 105 in its initial position. Thus the force of the small hydraulic-ram 136 is now greater than the force acting behind the large hydraulic-ram 135, so that small hydraulic-ram 136 now becomes the effective controller of the machine 1, and the eccentricity of the track-ring 105 relative to the pintle-valve 7 is reduced from the initial position. As the small hydraulic-ram 136 remains at delivery pressure whereas the level of pressure acting on the large hydraulic-ram 135 is governed by the magnitude of the pressure drop across orifice 115, the opposing forces on the projecting collar 102 of the track-ring 105 are sufficient to keep the vibration of the track-ring 105 to a very low levels. When the track-ring 105 is moved into a concentric relationship with the pintle-valve 7, the pistons 93 no-longer reciprocate in their respective cylinder-bores 90, and fluid is no-longer displaced through the machine 1.

By this simple and inexpensive means, the pump displacement is controlled with a high degree of stability and accuracy. In order to change the operating characteristics of the machine 1, the tension of coil-spring 185 can be adjusted by means of screw 190.

While this invention has been described as having a preferred design, it can be further modified within the teachings of this disclosure. This application is therefore intended to cover any variation, uses, or adaptations of the invention following its general principles. This application is also intended to cover departures from the present disclosure as come within known or customary practice in the art to which this invention pertains and falls within the limits of the appended claims.

We claim:

1. A radial piston hydrostatic machine having a rotary drive-shaft; a housing supporting said drive-shaft and comprising two shells connectable together along a parting plane; a stroking track-ring the relative position of which determines the operation and performance of said machine and means for controlling the position of said track-ring, wherein said control means includes actuation support means containing internal fluid channels and wherein said actuation support means is located and retained in said housing by said shells.

2. A radial hydrostatic machine according to claim 1 wherein said parting plane is coincident with the rotating axis of said drive-shaft.

3. A radial piston hydrostatic machine according to claim 1 wherein said stroking track-ring is pivotably mounted on a pin fixed in said housing, said track-ring being provided with a control-pin which projects into said actuation support means to be operatively connected by one or more hydraulic-rams.

4. A radial piston hydrostatic machine according to claim 1 wherein said actuation support means contains working elements of the pressure control mechanism of said machine.

5. A radial piston hydrostatic machine according to claim 4 wherein said working elements include a throttle-valve, a pressure relief-valve and first and second hydraulic-rams of unequal size.

6. A radial piston hydrostatic machine according to claim 5 wherein said stroking track-ring varies the work stroke of said machine between maximum stroke and minimum stroke positions, fluid inlet means and fluid discharge means for said machine, said first and second hydraulic-rams operating to position said track-ring, means for subjecting said first hydraulic-ram at all times to the full discharge pressure of said machine, means including said throttle-valve and said relief-valve member for selectively subjecting said second hydraulic-ram to operate at either said full discharge pressure or the "cracking" pressure of said relief-valve.

7. A radial piston hydrostatic machine according to claim 6 wherein said throttle-valve introduces a pressure-drop between said fluid discharge means and said second hydraulic-ram during periods when said relief-valve is operating in an "open" mode.

8. A radial piston hydrostatic machine according to claim 5 including biasing means for maintaining said stroking track-ring in a maximum stroke position initially, means for reducing said stroke of said machine to maintain the fluid pressure differential between fluid discharge means and said fluid inlet means substantially constant, said means comprising said first and second hydraulic-rams adapted to move said stroking track-ring, said first and second hydraulic-rams being reciprocable in first and second cylinders respectively and moveable in response to fluid pressure in said cylinders, said relief-valve selectively subjecting one of said cylinders to the "cracking" pressure of said relief-valve independently of the pressure level in the other said cylinder, whereby said hydraulic-rams may move said stroking track-ring towards a minimum stroke position to maintain said pressure differential between said fluid discharge means and said fluid inlet means substantially constant.

9. A radial piston hydrostatic machine according to claim 8 wherein the greater pressure force generated by the larger of the two said hydraulic-rams causes said track-ring to move to a maximum stroke position, and counter-biasing means for moving said track-ring towards said minimum stroke position when the discharge pressure across said machine exceeds a pre-set condition of said pressure relief-valve, said counter-biasing means comprising said throttle-valve and said pressure relief-valve operating together to change the relative pressure levels between said first and second cylinders in favor of the smaller diameter said cylinder.

10. A radial piston hydrostatic machine according to claim 4, wherein said stroking track-ring is operately connected to two hydraulic-rams, said hydraulic-rams contained within first and second cylinders respectively, means for controlling the flow of working fluid from said first fluid cylinder to said second fluid cylinder, equal pressure of working fluid in said first and second cylinders to bias said hydraulic-rams in a first direction, unequal pressure of working fluid in said first and second cylinders to oppositely bias said hydraulic-rams in a second direction.

11. A radial piston hydrostatic machine according to claim 10 wherein said controlling means comprising a throttle-valve and a pressure relief-valve, and where said throttle-valve has an orifice of less than 1.5 mm diameter.

12. In a radial piston hydrostatic machine including a housing and having a stroking track-ring for varying the work stroke of said machine between maximum stroke and minimum stroke positions; pressure actuated means comprising first and second hydraulic-rams contained within first and second cylinders respectively for moving said stroking track-ring to a maximum stroke position initially; first fluid channel means for connecting said first cylinder to a fluid discharge passageway for said machine; second fluid channel means including a throttle-valve for connecting said first and second cylinders together, differential pressure between said first and second cylinders causing movement of said track-ring towards a minimum stroke position to respond to changes in said discharge pressure of said machine.

13. In a radial piston hydrostatic machine according to claim 12 wherein a pressure relief valve in communication with second fluid channel means is caused to "open" when the discharge pressure of said machine reaches the same level as the pre-set condition of said relief-valve, the resultant fluid passing through said pressure relief-valve results in differential pressure across said throttle-valve, thereby reducing the pressure level in said second cylinders to a lower level than both said first cylinder and said discharge pressure passageway.

14. In a radial piston hydrostatic machine according to claim 13 wherein said pressure relief valve is internally disposed within said machine.

15. In a radial piston hydrostatic machine according to claim 13 wherein said first cylinder is smaller in projected area than said second cylinder.

16. In a radial piston hydrostatic machine according to claim 15 wherein said second hydraulic-ram causes said stroking track-ring to move towards a maximum stroke position when the pressure level in said first and second cylinders is substantially the same, and where said first hydraulic-ram causes said stroking track-ring to move towards a minimum stroke position when the pressure level in said first and second cylinders is not substantially the same.

17. In a radial piston hydrostatic machine according to claim 12 wherein spring means located in said second cylinder acts on said second hydraulic-ram to move said stroking track-ring towards a maximum stroke position when said machine is no-longer operational.

* * * * *